US008701750B2

(12) United States Patent
Oh et al.

(10) Patent No.: US 8,701,750 B2
(45) Date of Patent: Apr. 22, 2014

(54) HEAT EXCHANGER

(75) Inventors: Kwang Hun Oh, Daejeon (KR); Hong-Young Lim, Daejeon (KR); Young-Ha Jeon, Daejeon (KR)

(73) Assignee: Halla Visteon Climate Control Corporation, Daejeon (KR)

( * ) Notice: Subject to any disclaimer, the term of this patent is extended or adjusted under 35 U.S.C. 154(b) by 1000 days.

(21) Appl. No.: 12/741,936

(22) PCT Filed: Nov. 7, 2008

(86) PCT No.: PCT/KR2008/006590
§ 371 (c)(1),
(2), (4) Date: May 7, 2010

(87) PCT Pub. No.: WO2009/061157
PCT Pub. Date: May 14, 2009

(65) Prior Publication Data

US 2011/0100614 A1 May 5, 2011

(30) Foreign Application Priority Data

Nov. 9, 2007 (KR) ..... 10-2007-0114206
Nov. 7, 2008 (KR) ..... 10-2008-0110358

(51) Int. Cl.
*F28F 9/02* (2006.01)
*F25B 39/02* (2006.01)

(52) U.S. Cl.
USPC ..... 165/174; 165/175

(58) Field of Classification Search
CPC ..... F28F 9/0204
USPC ..... 165/153, 174, 175, 176; 62/515
See application file for complete search history.

(56) References Cited

U.S. PATENT DOCUMENTS 5,582,239 A * 12/1996 Tsunoda et al. ..... 165/76
7,222,501 B2 5/2007 Cho et al.
7,222,663 B2 5/2007 Higashiyama (Continued)

FOREIGN PATENT DOCUMENTS

CN 1820176 A 8/2006
DE 10 2004 056 790 A1 4/2006

(Continued)

OTHER PUBLICATIONS

Office Action mailed Oct. 8, 2011 in Chinese Application No. No. 200880123931.3 with English translation.

(Continued)

*Primary Examiner* — Tho V Duong
(74) *Attorney, Agent, or Firm* — Lowe Hauptman & Ham, LLP

(57) ABSTRACT

One or more embodiments of the present invention relates to a heat exchanger. The heat exchanger comprises a pair of header-tanks having at least one partition wall and at least one baffle; a plurality of tubes; and a plurality of fins. A communication hole is formed on the partition wall that is positioned at a region disposed between the baffle and one end of the header-tank adjacent to the baffle. Given that a distance from the baffle to the one end of the header-tank is 100%, 1~4 communication holes are formed at positions on the partition wall which corresponds to an extent of 0~50%, 65~100%, or an extent of 0~50% and an extent of 65~100%.

21 Claims, 11 Drawing Sheets

(A)

(B)

(56) References Cited

U.S. PATENT DOCUMENTS

| | | | | |
|---|---|---|---|---|
| 8,353,330 | B2 * | 1/2013 | Lim et al. | 165/76 |
| 2004/0159121 | A1 * | 8/2004 | Horiuchi et al. | 62/526 |
| 2005/0172664 | A1 * | 8/2005 | Cho et al. | 62/515 |
| 2005/0247443 | A1 * | 11/2005 | Kim | 165/176 |
| 2006/0054310 | A1 | 3/2006 | Kim et al. | |
| 2009/0266528 | A1 * | 10/2009 | Saito et al. | 165/153 |

FOREIGN PATENT DOCUMENTS

| | | | |
|---|---|---|---|
| JP | 07-305990 | | 11/1995 |
| JP | 2002-071283 | | 3/2002 |
| JP | 2004-184018 | A | 7/2004 |
| JP | 2005-265356 | | 9/2005 |
| JP | 06023780 | A | 2/2013 |
| KR | 10-2004-0062390 | | 7/2004 |
| KR | 10-2004-0062390 | A | 7/2004 |
| KR | 10-2006-0028809 | | 4/2006 |
| KR | 10-2006-0028809 | A | 4/2006 |
| WO | 2005/003670 | A1 | 1/2005 |

OTHER PUBLICATIONS

Office Action of corresponding application No. PCT/KR2008-0110358 mailed Dec. 13, 2012.

Office Action of corresponding application No. PCT/DE2008/003011.1.

* cited by examiner (A)

(B)

(A) (B)

(A)

(B)

HEAT EXCHANGER

RELATED APPLICATIONS

The present application is based on, and claims priority from, KR Application Number 10-2007-0114206, filed Nov. 9, 2007; KR Application Number 10-2008-0110358, filed Nov. 7, 2008; and PCT Application Number PCT/KR08/006,590, filed Nov. 7, 2008, the disclosures of which are hereby incorporated by reference herein in their entireties.

TECHNICAL FIELD

The present invention relates to a heat exchanger, and more particularly, to a heat exchanger which can optimize a position and size of a communicating hole for changing a flow path in the heat exchanger.

BACKGROUND ART

In the automobile industry, as general concerns about energy and environment are increased globally, the efficiency in each part including fuel efficiency has been steadily improved, and the external appearance of a vehicle has been also diversified in order to satisfy various demands of customers. According to such a tendency, research and development on lighter weight, smaller size and multi-function of each vehicle component has been carried out. Particularly, in an air-conditioning unit for a vehicle, since it is generally difficult to secure an enough space in an engine room, there have been many efforts to manufacture a heat exchange system having a small size and high efficiency.

Meanwhile, the heat exchange system generally includes an evaporator for absorbing heat from a peripheral portion, a compressor for compressing refrigerant, a condenser for radiating heat to a peripheral portion, and an expansion valve for expanding the refrigerant. In an air-conditioning system, the gaseous refrigerant introduced from the evaporator to the compressor is compressed at a high pressure and high temperature, and the compressed gaseous refrigerant radiates liquefaction heat to a peripheral portion while passing through the condenser so as to be liquefied, and the liquefied refrigerant is passed through the expansion valve so as to be in a low pressure low temperature wet vapor state and then introduced again into the evaporator so as to be vaporized, and thus the air conditioning substantially occurs in the evaporator that absorbs vaporization heat from a peripheral portion while the wet vapor refrigerant is vaporized. As described above, the condenser and evaporator in the air-conditioning system typically fall into the category of the heat exchanger.

FIG. 1 is a perspective view of a general heat exchanger. As shown in the drawing, the heat exchanger 100 includes a pair of header-tanks 10, a plurality of tubes 20 and a plurality of fins 30. The header-tank 10 includes a plurality of tube insertion holes 13 that are formed at a lower surface or an upper surface thereof to be extended in a width direction thereof and arranged in a longitudinal direction thereof, an end cap 14 that closes both longitudinal ends thereof, at least one partition wall 11 that partitions an inner space as a refrigerant passage in the longitudinal direction and at least one baffle 12 that partitions the refrigerant passage in the width direction. Further, both ends of the tube 20 are fixedly inserted into the tube insertion hole 13 of the header-tank 10 to form a refrigerant passage, and the fin 30 is interposed between the tubes 20 to enhance heat exchange performance.

FIG. 2 shows a flow of the refrigerant in the heat exchanger as described above, wherein FIG. 2A is a schematic view of the heat exchanger to shown the refrigerant flow indicated by an arrow, and FIG. 2B is a schematic view showing the refrigerant flow in a status that each row of the hear tanks 10 arranged in two rows is separated from each other and the tubes are omitted. As shown in the drawing, in a first row 10*b*1 of lower header-tank and a second row 10*b*2 of lower header-tank, the refrigerant passage is partitioned by the baffle 12. First, the refrigerant introduced into a front space of the baffle 12 is flowed into a first row 10*a*1 of upper header-tank through the tube 20. Because the refrigerant is introduced through only one side of the first row 10*a*1 of upper header-tank, the refrigerant introduced into the first row 10*a*1 of upper header-tank is flow to the other side, i.e., an empty space in a direction indicated by an arrow, and then introduced into a rear space of the baffle 12 in the first row 10*b*1 of lower header-tank through the tube 20.

The first row 10*b*1 of lower header-tank and the second row 10*b*2 of lower header-tank are communicated with each other through a communication hole 15' formed at the rear space of the baffle 12, and thus the refrigerant introduced into the first row 10*b*1 of lower header-tank is flowed through the communication hole 15' to the rear space of the baffle 12 in the second row 10*b*2 of lower header-tank. Then, the refrigerant is exhausted to an outside through the rear space of the baffle 12 in the second row 10*b*2 of lower header-tank, a second row 10*a*2 of upper header-tank and the front space of the baffle 12 in the second row 10*b*2 of lower header-tank.

However, in the heat exchanger having the refrigerant flow as described above, there has been many problems in designing the communication hole. There has been disclosed Japanese Patent Publication No. 2002-071283 (hereinafter, called "conventional invention") relevant to the design of the communication hole. FIG. 3 shows a cross-sectional view and a perspective view of a heat exchanger according to the conventional invention. As shown in the drawing, in the conventional invention, one communication hole is formed at one tube. However, if one communication hole is formed at one tube, a structure of the heat exchanger is complicated due to many holes, and manufacturing cost is increased. Also, since there is a high possibility of generating a dead zone due to non-uniformity of the refrigerant flow, a temperature distribution is non-uniform and thus the heat exchange performance is deteriorated. Further, there is an inconvenience in that the communication hole should be redesigned according to the standard of the fin. Furthermore, since the communication hole is formed at every tube, durability is considerably reduced.

DISCLOSURE OF INVENTION

Technical Problem

Therefore, an object of the present invention is to provide a heat exchanger which can optimize a position and size of a communicating hole for changing a flow of refrigerant.

Another object of the present invention is to provide a heat exchanger which can simplify a structure of the communication hole so as to reduce designing and manufacturing cost and also make a temperature distribution uniform, thereby improving heat exchange performance.

Technical Solution

To achieve the above objects, the present invention provides a heat exchanger 100, comprising a pair of header-tanks 10 which are arranged in parallel to be spaced apart from each other, and each of which forms an inner space as a refrigerant passage as both longitudinal ends are closed and comprises at least one partition wall 11 that partitions the refrigerant passage along a width direction and at least one baffle 12 that partitions the refrigerant passage along a longitudinal direction; a plurality of tubes 20 of which both ends are fixedly inserted into the header-tank 10 to form a refrigerant passage; and a plurality of fins 30 which are interposed between the tubes 20, wherein a communication hole 15 is formed on the partition wall 11 that is positioned at a region disposed between the baffle 12 and one end of the header-tank 10 adjacent to the baffle 12, and assuming that a distance from the baffle 12 to the one end of the header-tank 10 is 100%, from one to four communication holes 15 are formed at positions on the partition wall 11 which corresponds to an extent of 0~50%.

Further, the present invention provides a heat exchanger, comprising a pair of header-tanks 10 which are arranged in parallel to be spaced apart from each other, and each of which forms an inner space as a refrigerant passage as both longitudinal ends are closed and comprises at least one partition wall 11 that partitions the refrigerant passage along a width direction and at least one baffle 12 that partitions the refrigerant passage along a longitudinal direction; a plurality of tubes 20 of which both ends are fixedly inserted into the header-tank 10 to form a refrigerant passage; and a plurality of fins 30 which are interposed between the tubes 20, wherein a communication hole 15 is formed on the partition wall 11 that is positioned at a region disposed between the baffle 12 and one end of the header-tank 10 adjacent to the baffle 12, and assuming that a distance from the baffle 12 to the one end of the header-tank 10 is 100%, from one to four communication holes 15 are formed at positions on the partition wall 11 which corresponds to an extent of 65~100%.

Further, the present invention provides a heat exchanger, comprising a pair of header-tanks 10 which are arranged in parallel to be spaced apart from each other, and each of which forms an inner space as a refrigerant passage as both longitudinal ends are closed and comprises at least one partition wall 11 that partitions the refrigerant passage along a width direction and at least one baffle 12 that partitions the refrigerant passage along a longitudinal direction; a plurality of tubes 20 of which both ends are fixedly inserted into the header-tank 10 to form a refrigerant passage; and a plurality of fins 30 which are interposed between the tubes 20, wherein a communication hole 15 is formed on the partition wall 11 that is positioned at a region disposed between the baffle 12 and one end of the header-tank 10 adjacent to the baffle 12, and assuming that a distance from the baffle 12 to the one end of the header-tank 10 is 100%, from one to four communication holes 15 are formed at positions on the partition wall 11 which corresponds to an extent of 0~50% and an extent of 65~100%.

Preferably, the baffle 12 is formed at one of the pair of the header-tanks 10.

Preferably, the head-tank 10 includes end caps 14 that close the both ends of the header-tank 10.

Preferably, the baffle 12 is disposed respectively inside a plurality of the refrigerant passages formed to be partitioned by the partition wall 11, and positioned in parallel with other baffle 12 at the same position in the respective refrigerant passages.

Preferably, the communication hole 15 is formed so that a ratio of a surface area (S) of the communication hole per a cross-sectional area ($S_T$) of the header-tank is in an extent of 70~240%, and more preferably, the communication hole 15 is formed so that the ratio of the surface area (S) of the communication hole per a cross-sectional area ($S_T$) of the header-tank is in an extent of 70~160%.

Preferably, the communication hole 15 is formed so that so that a cross-sectional area ($S_t$) of the partition wall 11 having the communication hole 15 is in an extent of 7~20 $mm^2$, and a thickness of the partition wall 11 is 2 mm, and a distance between the communication holes 15 is in an extent of 3.5~10 mm.

Preferably, the baffle 12*a* is disposed inside the upper header-tank 10*a*1, 10*a*2, and the communication hole 15*a* is formed at an upper partition wall 11*a*, and the refrigerant in the heat exchanger is introduced into a front space of the baffle 12*a* of a first row 10*a*1 of upper header-tank, passed through a tube 20, a first row 10*b*1 of lower header-tank, a tube 20, a rear space of the baffle 12*a* of the first row 10*a*1 of upper header-tank, the communication hole 15*a*, a rear space of the baffle 12*a* of the second row 10*a*2 of upper header-tank, a tube 20, a second row 10*b*2 of lower header-tank, a tube 20, and then exhausted to an outside through a front space of the baffle 12*a* of the second row 10*a*2 of upper header-tank.

Alternatively, the baffle 12*a* is disposed inside the lower header-tank 10*b*1, 10*b*2, and the communication hole 15*b* is formed at a lower partition wall 11*b*, and the refrigerant in the heat exchanger is introduced into a front space of the baffle 12*b* of a first row 10*b*1 of lower header-tank, passed through a tube 20, a first row 10*a*1 of upper header-tank, a tube 20, a rear space of the baffle 12*b* of the first row 10*b*1 of lower header-tank in turn, the communication hole 15*b*, a rear space of the baffle 12*b* of the second row 10*b*2 of lower header-tank, a tube 20, a second row 10*a*2 of upper header-tank, a tube 20 in turn, and then exhausted to an outside through a front space of the baffle 12*b* of the second row 10*b*2 of lower header-tank.

Also, alternatively, the baffle 12*a* includes upper and lower baffles 12*c*1, 12*c*2, which are disposed inside the upper header-tank 10*a*1, 10*a*2 and the lower header-tank 10*b*1, 10*b*2, respectively, and the communication hole 15*c* is formed at a position on a lower partition wall 11*c* which is between an end of the lower header-tank which is opposite to an inlet and outlet port of the refrigerant and the lower baffle 12*c*2 adjacent thereto, the refrigerant in the heat exchanger is introduced into a front space of the upper baffle 12*c*1 of a first row 10*a*1 of upper header-tank, passed through a tube 20, a front space of the lower baffle 12*c*2 of the first row 10*b*1 of lower header-tank, a tube 20, a rear space of the upper baffle 12*c*1 of a first row 10*a*1 of upper header-tank, the communication hole 15*c*, a rear space of the lower baffle 12*c*2 of the second row 10*b*2 of lower header-tank, a tube 20, a rear space of the upper baffle 12*c*1 of the second row 10*a*2 of upper header-tank, a tube 20, a front space of the lower baffle 12*c*2 of the second row 10*a*2 of lower header-tank, a tube 20 in turn, and then exhausted to an outside through a front space of the lower baffle 12*c*2 of the second row 10*b*2 of lower header tank.

Furthermore, the present invention provides a heat exchanger, comprising a pair of header-tanks 10 which are arranged in parallel to be spaced apart from each other, and each of which forms an inner space as a refrigerant passage as both longitudinal ends are closed and comprises at least one partition wall 11 that partitions the refrigerant passage along a width direction and at least one baffle 12 that partitions the refrigerant passage along a longitudinal direction; a plurality of tubes 20 of which both ends are fixedly inserted into the header-tank 10 to form a refrigerant passage; and a plurality of fins 30 which are interposed between the tubes 20, wherein a communication hole 15 is formed on the partition wall 11 that is positioned at a region disposed between the baffle 12 and one end of the header-tank 10 adjacent to the baffle 12, and the communication hole 15 is formed so that a ratio of a surface area (S) of the communication hole per a cross-sectional area ($S_T$) of the header-tank is in an extent of 70~240%. Preferably, the communication hole 15 is formed so that the ratio of the surface area (S) of the communication hole per a cross-sectional area ($S_T$) of the header-tank is in an extent of 70~160%.

Preferably, the communication hole 15 is formed so that so that a cross-sectional area ($S_t$) of the partition wall 11 having the communication hole 15 is in an extent of 7~20 $mm^2$, and a thickness of the partition wall 11 is 2 mm, and a distance between the communication holes 15 is in an extent of 3.5~10 mm.

Advantageous Effects

According to the present invention, since the structure of the communication hole is simplified, it is facile to design and manufacture the heat exchanger, and thus it is possible to remarkably reduce the designing and manufacturing cost. Further, in the present invention, the refrigerant flow is improved by restricting generation of a dead zone so that the refrigerant is uniformly distributed and thus the temperature distribution also becomes uniform, thereby remarkably increasing the heat exchange performance of the heat exchanger.

Further, in the conventional invention, since the communication hole was formed at every tube, the structure of the communication hole was directly affected by the number of the tubes. However, in the present invention, since the structure of the communication hole is not affected by the number of the tubes, although the structure of the tube and the fin is changed, it is not necessary to change the structure of the communication hole, or it is very simple to change the structure of the communication hole, thereby facilely manufacturing a new product.

Furthermore, in the conventional invention, since many communication holes was formed at the internal wall of the header-tank and thus stress was concentrated on the internal wall between the communication holes, it was easy to damage the internal wall of the header-tank, thereby reducing the durability. However, since the present invention can optimize the position and size of the communicating hole, it is possible to smoothly flow the refrigerant and also prevent the concentration of stress, thereby considerably enhancing the durability.

BRIEF DESCRIPTION OF THE DRAWINGS

The above and other objects, features and advantages of the present invention will become apparent from the following description of preferred embodiments given in conjunction with the accompanying drawings, in which.

DETAILED DESCRIPTION OF MAIN ELEMENTS

Figure 1:
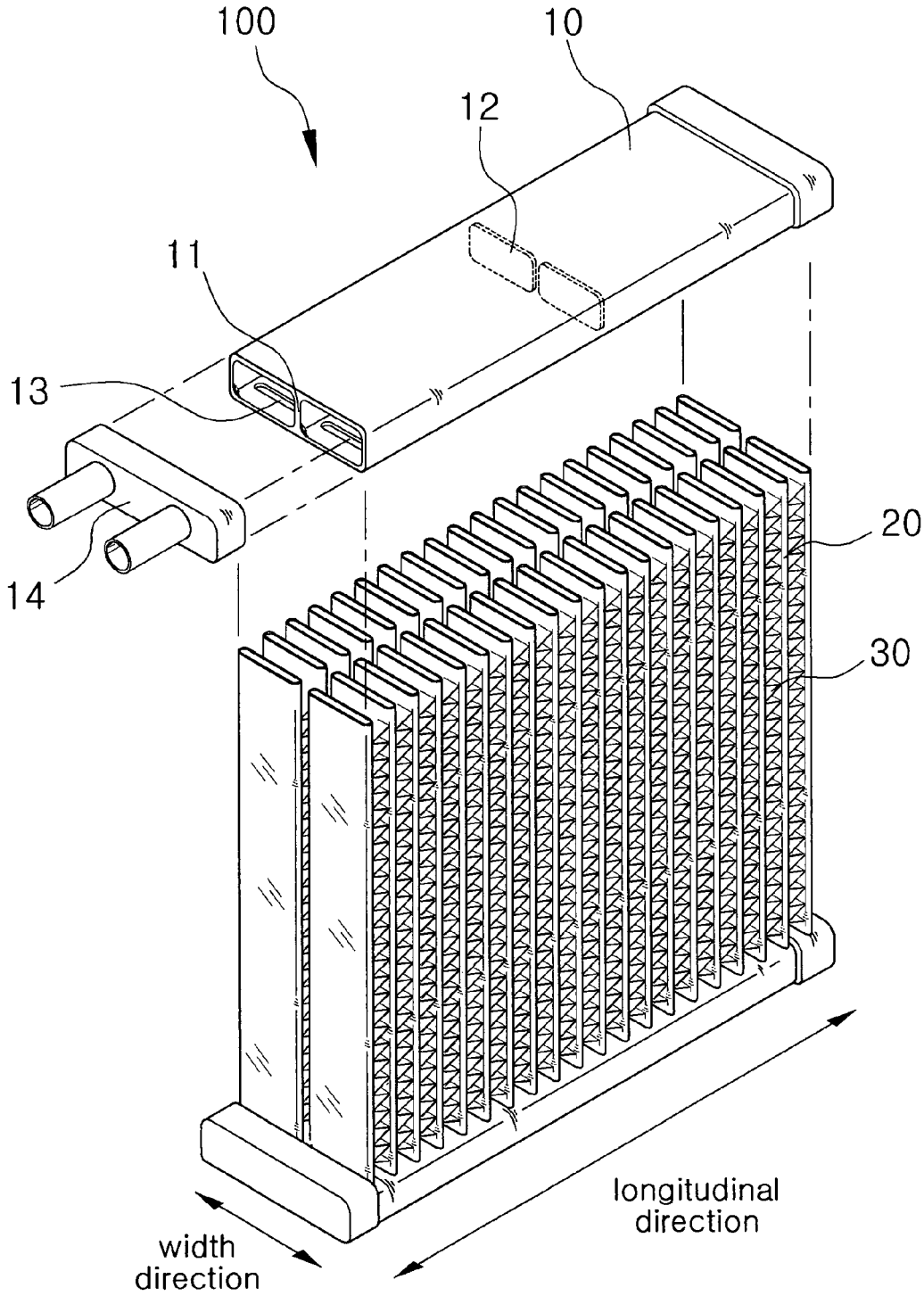
FIG. 1 is a perspective view of a general heat exchanger.
Figure 2:
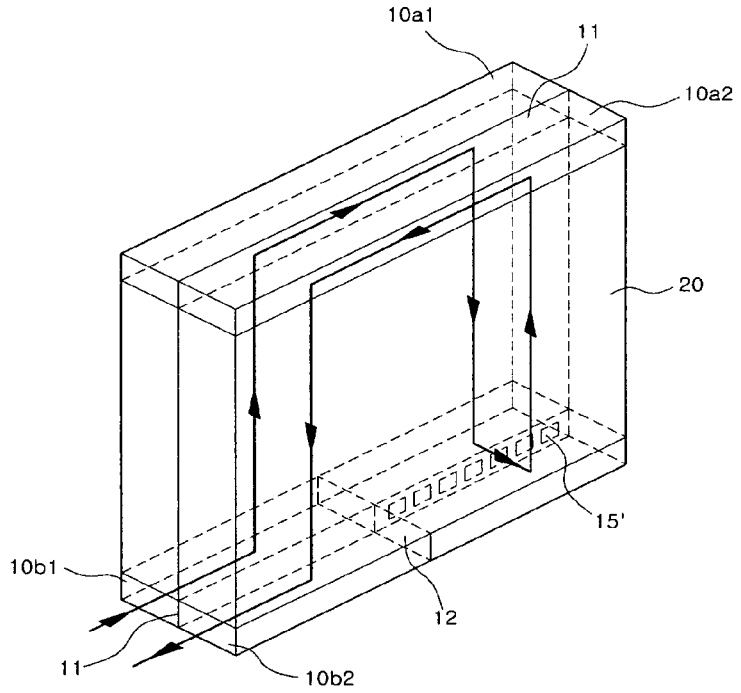
FIG. 2 is a view showing a flow of refrigerant in the general heat exchanger.
Figure 2:
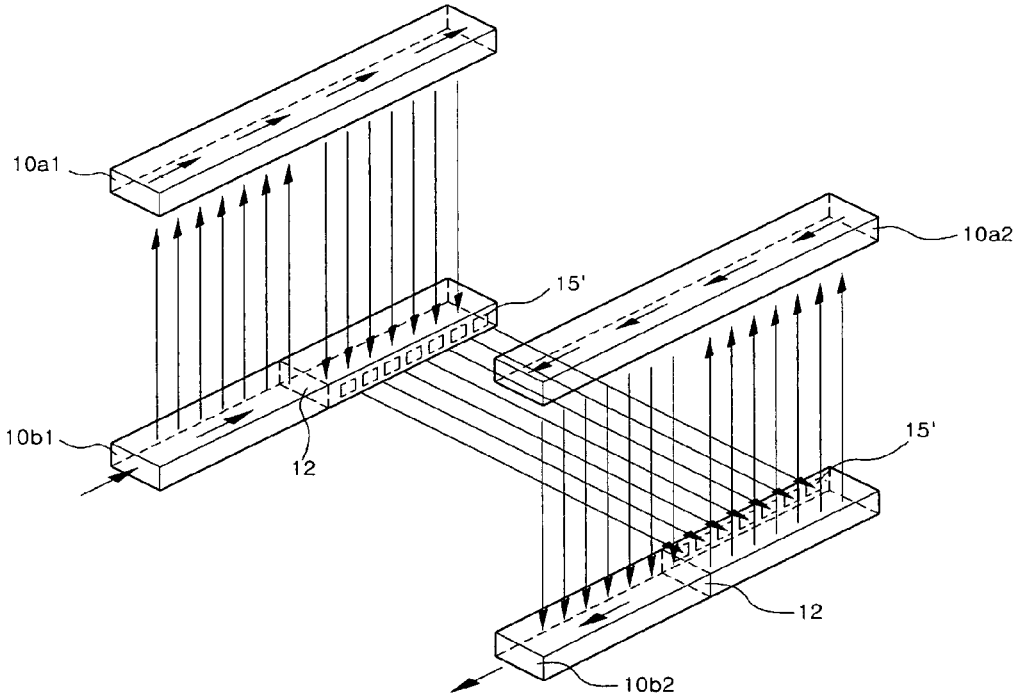
Figure 3:
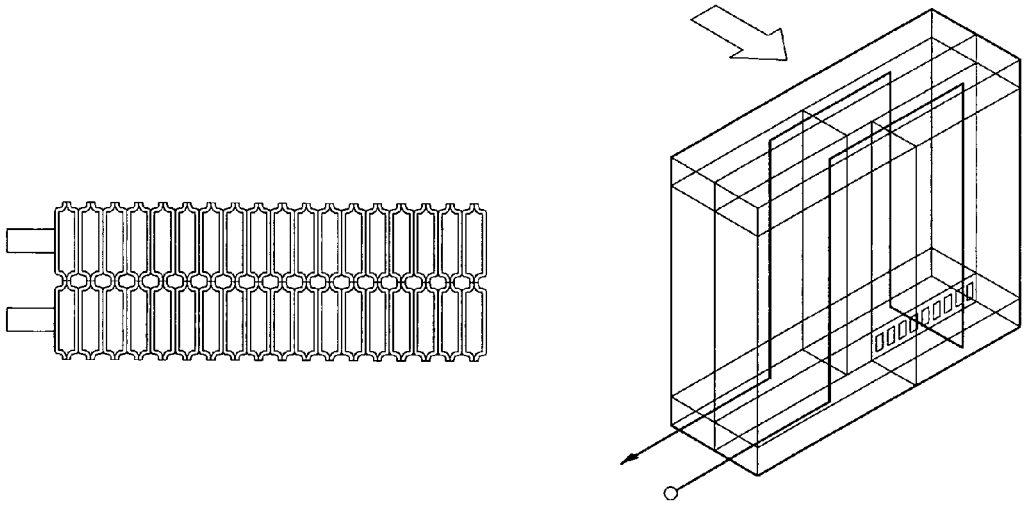
FIG. 3 is a view showing structure of a communication hole in the general heat exchanger.

10: header tank
**10*a*1**: first row of upper header-tank
**10*a*2**: second row of upper header-tank
**10*b*1**: first row of lower header-tank
**10*b*2**: second row of lower header-tank
11: partition wall 12: baffle
13: tube insertion hole 14: end cap
15', 15: communication hole 20: tube
30: fin

BEST MODE FOR CARRYING OUT THE INVENTION

Hereinafter, the embodiments of the present invention will be described in detail with reference to accompanying drawings.

Figure 4:
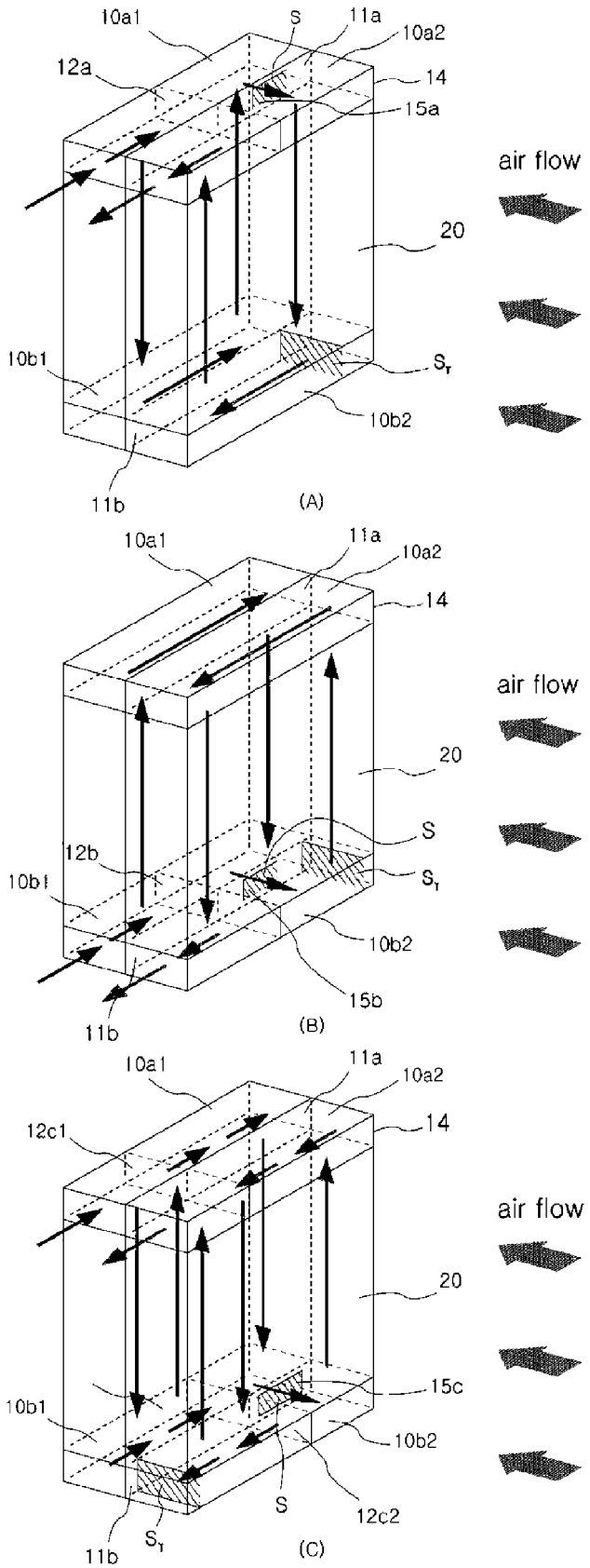
FIG. 4 are views showing structures of a communication hole in a heat exchanger according to the present invention.

FIG. 4 is a view showing structure of a communication hole in a heat exchanger according to the present invention, wherein FIG. 4A shows the structure of the communication hole according to a first embodiment of the present invention, FIG. 4B shows the structure of the communication hole according to a second embodiment of the present invention and FIG. 4C shows the structure of the communication hole according to a second embodiment of the present invention. As described above, the heat exchanger transforms a phase of the refrigerant (from liquid to gas in an evaporator, from gas to liquid in a condenser) by heat exchange and then exhausts the refrigerant. In order to efficiently perform the heat exchange, it is preferable that a core, i.e., a part comprised of a tube and a fin, has uniform temperature distribution. To this end, it is necessary to improve a flow path of the refrigerant. The above three embodiments of the present invention relates to an improved flow path of the refrigerant, which will be fully described below.

First, in the first embodiment of FIG. 4A, the refrigerant is introduced into a first row **10*a*1 of upper header-tank and then discharged to a second row 10*a*2 of upper header-tank, a baffle 12*a* is disposed inside each upper header-tank 10*a*1, 10*a*2, and a communication hole 15*a* is formed at an upper partition wall 11*a* provided inside the upper header-tanks. The refrigerant introduced into a front space of the baffle 12*a* of the first row 10*a*1 of upper header-tank is flowed through the front space of the baffle 12*a* of the first row 10*a*1 of upper header-tank, a tube 20, a first row 10*b*1 of lower header-tank, a tube 20 and a rear space of the baffle 12*a* of the first row 10*a*1 of upper header-tank in turn, and then introduced through the communication hole 15*a* into a rear space of the baffle 12*a* of the second row 10*a*2 of upper header-tank. The refrigerant flowing through the communication hole 15***a* is exhausted to an outside through the rear space of the baffle 12*a* of the second row 10*a*2 of upper header-tank, a tube 20, a second row 10*b*2 of lower header-tank, a tube 20 and a front space of the baffle 12*a* of the second row 10*a*2 of upper header-tank.

In the second embodiment of FIG. 4B, the refrigerant is introduced into a first row 10*b*1 of lower header-tank and then discharged to a second row 10*b*2 of lower header-tank, a baffle 12*b* is disposed inside each lower header-tank 10*b*1, 10*b*2, and a communication hole 15*b* is formed at a lower partition wall 11*b* provided inside the lower header-tanks. The refrigerant introduced into a front space of the baffle 12*b* of the first row 10*b*1 of lower header-tank, and flowed through the front space of the baffle 12*b* of the first row 10*b*1 of lower header-tank, a tube 20, a first row 10*a*1 of upper header-tank, a tube 20 and a rear space of the baffle 12*b* of the first row 10*b*1 of lower header-tank in turn, and then introduced through the communication hole 15*b* into a rear space of the baffle 12*b* of the second row 10*b*2 of lower header-tank. The refrigerant flowing through the communication hole 15*b* is exhausted to an outside through the rear space of the baffle 12*b* of the second row 10*b*2 of lower header-tank, a tube 20, a second row 10*a*2 of upper header-tank, a tube 20 and a front space of the baffle 12*b* of the second row 10*b*2 of lower header-tank.

In the third embodiment of FIG. 4C, the refrigerant is introduced into a first row 10*a*1 of upper header-tank and then discharged to a second row 10*a*2 of upper header-tank, upper and lower baffles 12*c*1, 12*c*2, are disposed inside the upper header-tank 10*a*1, 10*a*2 and the lower header-tank 10*b*1, 10*b*2, respectively, and the communication hole 15*c* is formed at a position on a lower partition wall 11*c* which is between an end of the lower header-tank which is opposite to an inlet and outlet port of the refrigerant and the lower baffle 12*c*2 adjacent thereto. The refrigerant is introduced into a front space of the upper baffle 12*c*1 of a first row 10*a*1 of upper header-tank, and flowed through the front space of the upper baffle 12*c*1 of a first row 10*a*1 of upper header-tank, a tube 20, a front space of the lower baffle 12*c*2 of the first row 10*b*1 of lower header-tank, a tube 20, a rear space of the upper baffle 12*c*1 of a first row 10*a*1 of upper header-tank in turn, and then introduced through the communication hole 15*c* into a rear space of the lower baffle 12*c*2 of the second row 10*b*2 of lower header-tank. The refrigerant flowing through the communication hole 15*c* is exhausted to an outside through a rear space of the upper baffle 12*c*1 of the second row 10*a*2 of upper header-tank, a tube 20, a front space of the lower baffle 12*c*2 of the second row 10*a*2 of lower header-tank, a tube 20 and then a front space of the lower baffle 12*c*2 of the second row 10*b*2 of lower header tank.

The first, second and third embodiments has the same structure, except positions of inlet and outlet ports of the refrigerant, a position of the baffle and a position of the partition wall having the communication hole. Therefore, the partition wall is indicated by a reference numeral 11, the baffle is indicated by a reference numeral 12 and the communication hole is indicated by a reference numeral 15 in the first, second and third embodiments, commonly.

In the conventional invention, one communication hole 15' was formed at every tube. However, in the present invention, a single or at least one communication hole 15 is formed at a part of the partition wall 11 so as to have a larger size than a tube pitch (a distance between tubes). Therefore, it is possible to reduce the manufacturing cost due to simple structure of the communication hole 15 and also to flexibly provide the communication hole 15 even when a size of the core, i.e., standards of the tube and the fin is changed. Further, it is possible to optimize the position, the size and the number of the communication holes 15, thereby enhancing the temperature distribution characteristic and the heat radiation amount comparing with the existing heat exchanger having the conventional communication hole 15'. The optimizing process of optimizing the position, the size and the number of the communication holes 15 according to the present invention will be described below. Experimental results described below are obtained using an evaporator as a heat exchanger. Thus, when the heat exchanger of the present invention is used as an evaporator, it is possible to obtain the best effect.

Figure 5:
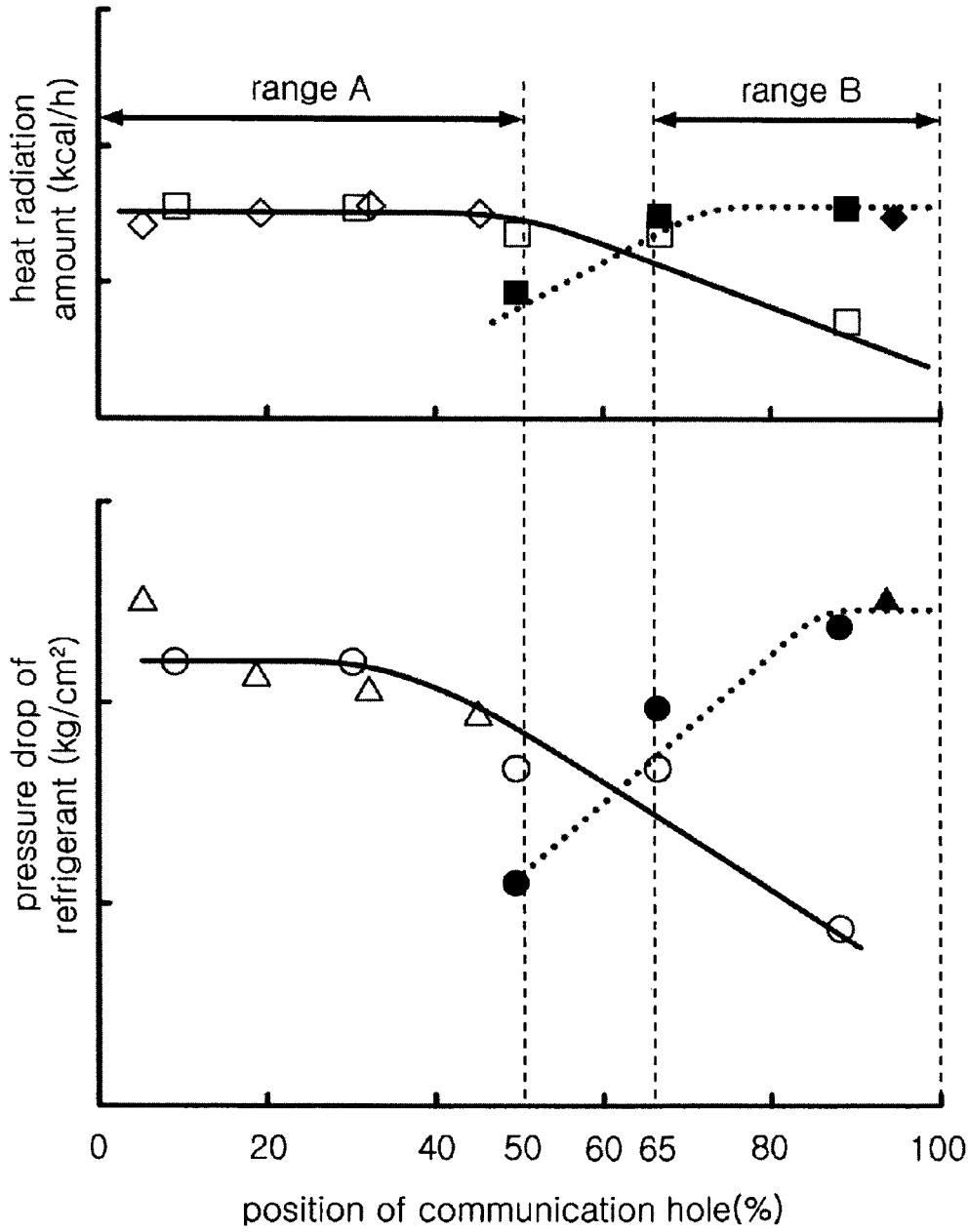
FIG. 5 is a graph showing a relationship among a position of the communication hole, a pressure drop and a heat radiation amount.
Figure 11:
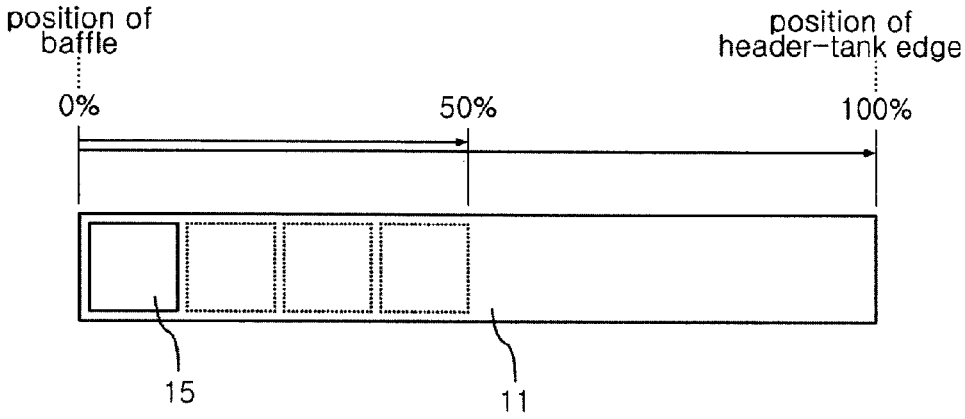
FIG. 11 is a reference view for defining a position of the communication hole.

FIG. 5 is a graph showing a relationship among a position of the communication hole, a pressure drop and a heat radiation amount, wherein a width axis is a position of the communication hole formed at the partition wall 11 that is disposed at the rear space of the baffle 12 of the lower header-tank, and as defined as shown in FIG. 11, 0% in the width axis is a position of the baffle 12 and 100% is a position of an end cap 14 for closing an end of the header-tank. As shown in the drawing, in case that the position of the communication hole 15 is between 0~50%, the heat radiation amount is not reduced, and thus it is preferable that the position of the communication hole 15 is between 0~50%. In addition, if it is intended that the communication hole be positioned at the side of the end cap, it is preferable that the position of the communication hole 15 is between 65~100%.

However, in case that only a single communication hole 15 is provided, the size of the communication hole 15 is so large and thus the durability is lowered, and in case that multiple communication holes 15 are provided, it is difficult to design and manufacture and thus the improved advantages are lost comparing with the conventional inventions. Therefore, it is required to properly provide the number of the communication holes.

Figure 6:
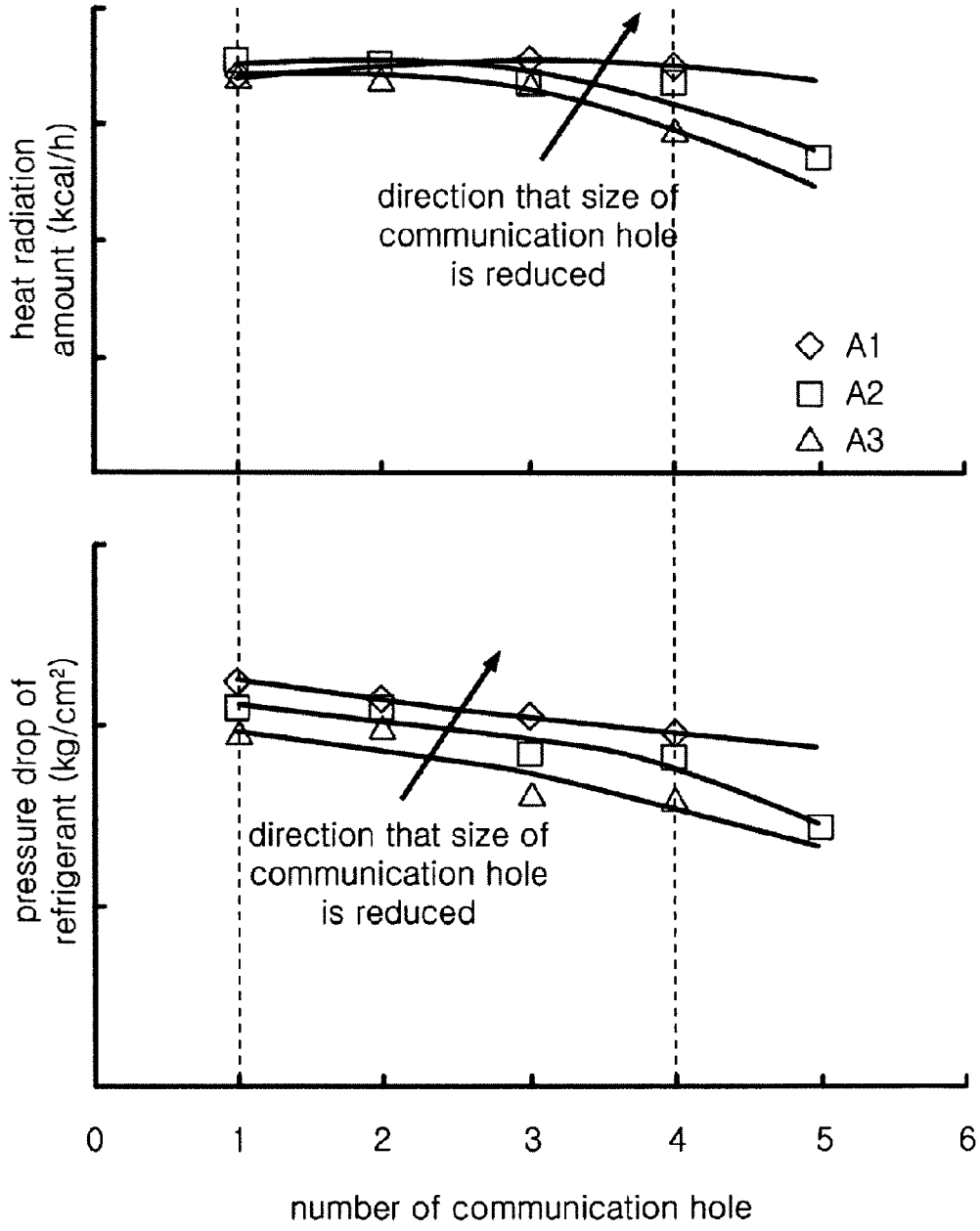
FIG. 6 a graph showing a relationship among the number of the communication holes, the pressure drop and the heat radiation amount.

FIG. 6 a graph showing a relationship among the number of the communication holes, the pressure drop and the heat radiation amount, wherein $A_1$, $A_2$ and $A_3$ indicate a size of each communication hole, and each size is $A_1>A_2>A_3$. As described above, the present invention is to facilely design and manufacture the heat exchanger by simplifying the communication hole 15 and also to increase the heat exchange performance. In the graph of FIG. 6, if the number of the communication holes is 4 or more, the heat radiation amount is sharply reduced, and thus it is preferable that the number of the communication holes is 4 or less. Further, one or more communication holes 15 may be provided considering the durability of the partition wall 11, and thus it is preferable that the number of the communication holes is from one to four.

Furthermore, FIG. 6 also shows performance characteristic according to change in a size of the communication hole 15. As shown in the drawing, a pressure drop of the refrigerant is increased, as a size of communication hole 15 is reduced. Therefore, the size of the communication hole 15 should be set.

Figure 7:
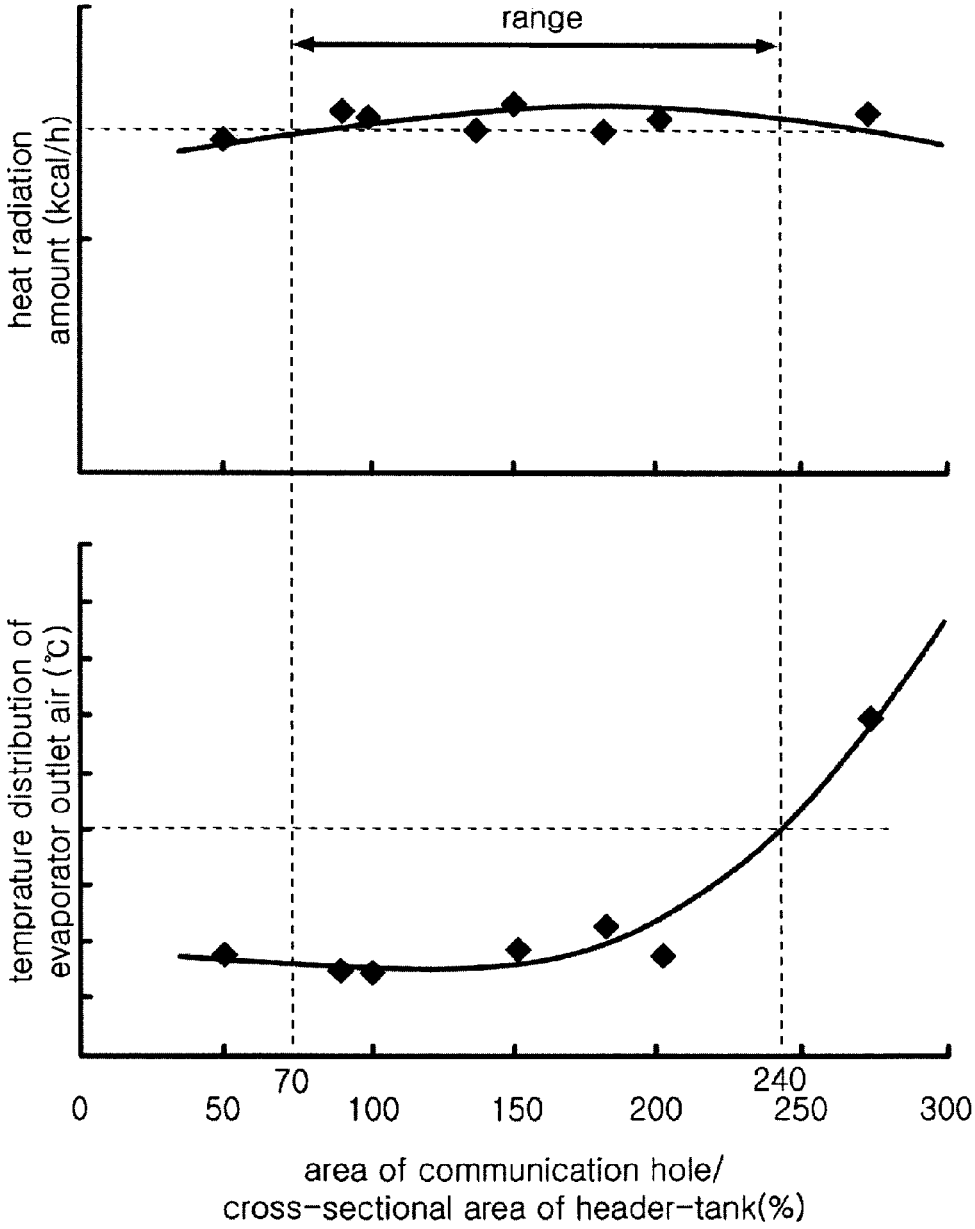
FIG. 7 is a graph showing a relationship among a surface area of communication hole per a cross-sectional area of header-tank, a temperature distribution of heat exchanger outlet air, and a heat radiation amount.
Figure 8:
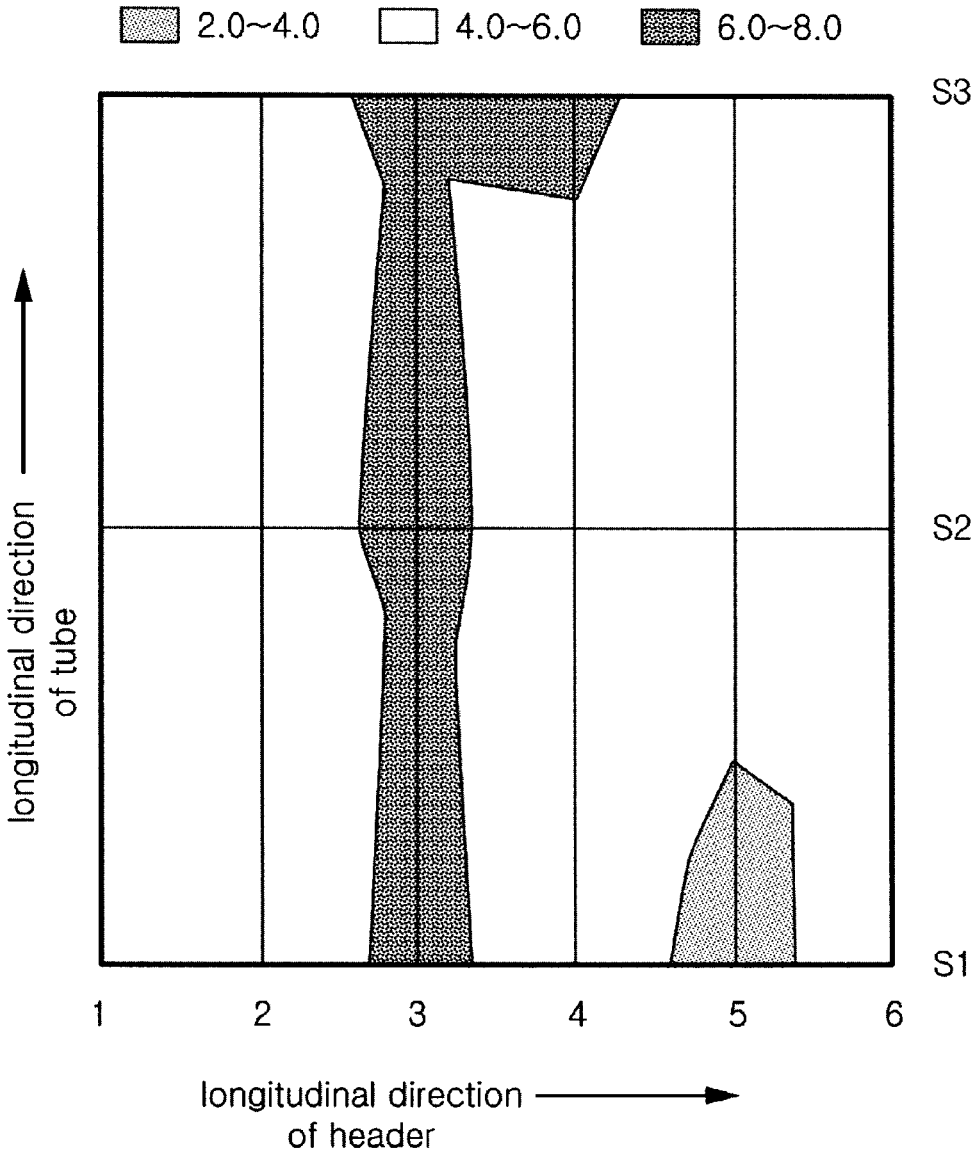
FIG. 8 is a graph showing an example of the temperature distribution of a core in the heat exchanger.
Figure 12:
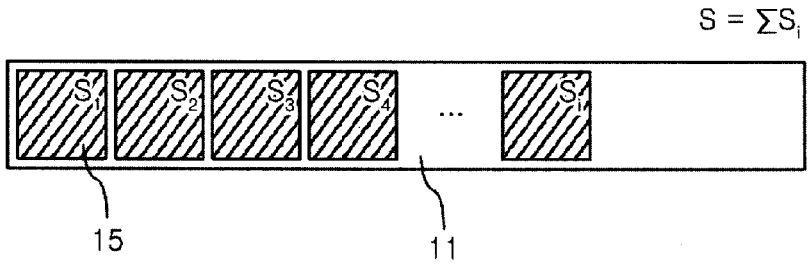
FIG. 12 is a reference view for defining an area of the communication hole.

FIG. 7 is a graph showing a relationship among a surface area of communication hole per a cross-sectional area of header-tank, a temperature distribution of heat exchanger outlet air, and a heat radiation amount and FIG. 8 is a graph showing an example of the temperature distribution of a core in the heat exchanger. The surface area of the communication hole is correspondent to a portion of S in FIG. 4, and the cross-sectional area of the header-tank is correspondent to a portion of $S_T$ in FIG. 4. More specifically, the surface area of the communication hole is defined, as shown in FIG. 12, by sum $\Sigma S_i$ of the surface areas ($S_1, S_2, \ldots, S_i$ in FIG. 12) of each communication hole when at least one communication hole is formed. As shown in FIG. 7, as a ratio of the surface area of the communication hole per the cross-sectional area of the header-tank is increased, the temperature distribution of heat exchanger outlet air is gradually increased. Particularly, a temperature of the heat exchanger outlet air is rapidly increased from a point that the ratio of the surface area of the communication hole per the cross-sectional area of the header-tank is 150%, and the temperature distribution (more than 4° C.) of the core is deteriorated. Further, the heat radiation amount has a maximum value when the ratio of the surface area of the communication hole per the cross-sectional area of the header-tank is 70~240%. Therefore, the size of the communication is preferably set to be 70~240% of the cross-sectional area of the header-tank 10. More preferably, the ratio of the surface area of the communication hole per the cross-sectional area of the header-tank is 70~160% in which the temperature distribution of the heat exchanger outlet air is uniform.

In order to avoid the problem that the durability of the partition wall 11 is lowered as the number of the communication holes 15 is reduced and the size thereof is increased, as described above, a thickness of the partition wall 11 having the communication hole 15 should be set properly.

Figure 9:
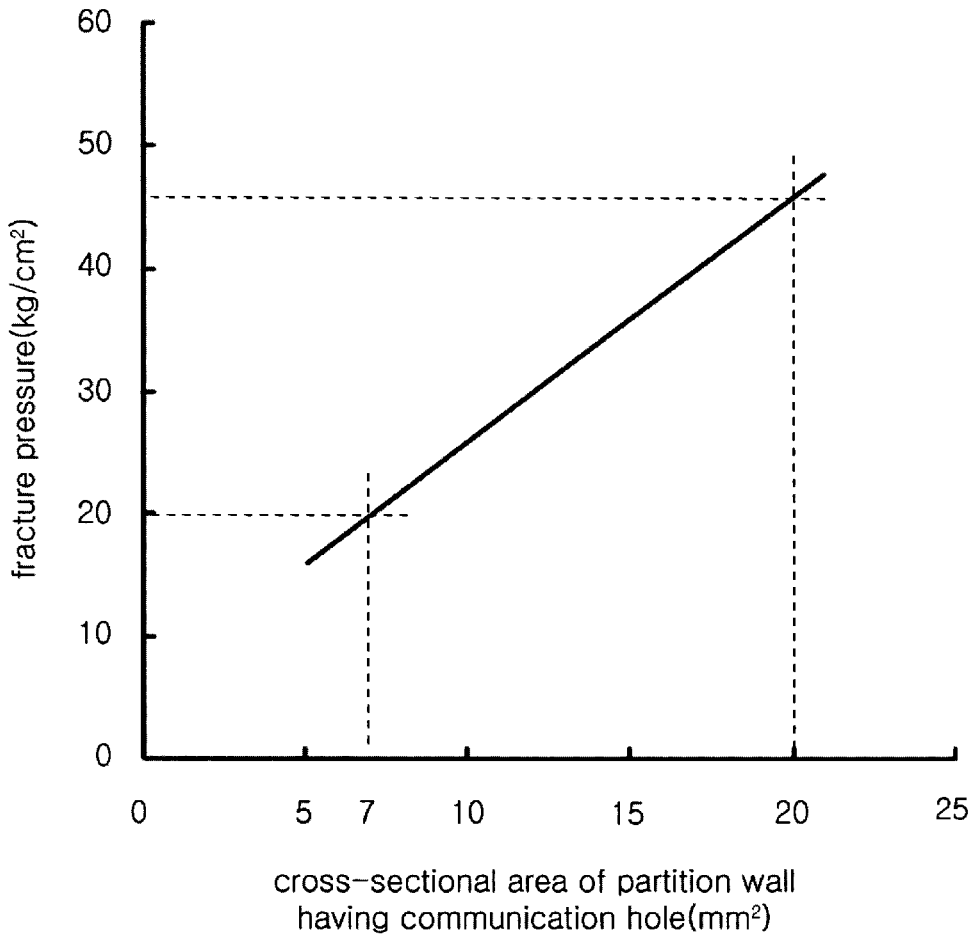
FIG. 9 is a graph showing a relationship between a cross-sectional area of a partition wall having the communication hole and a fracture pressure.
Figure 10:
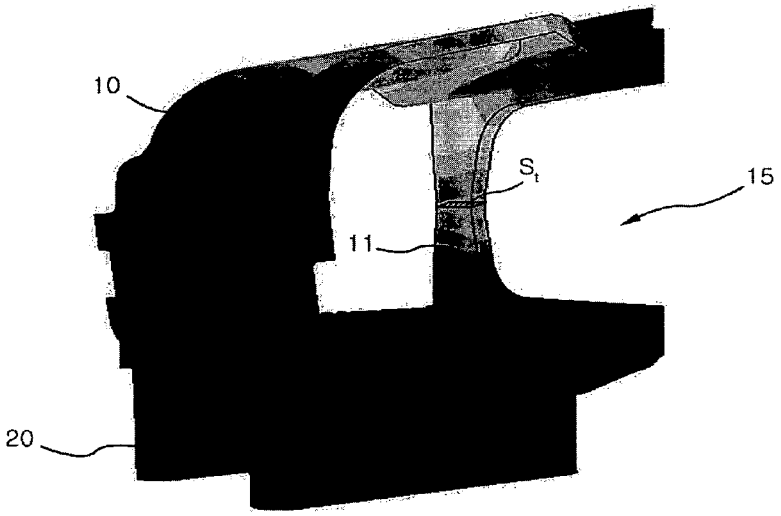
FIG. 10 is a view visually showing the result of structural analysis of a header-tank.
Figure 10:
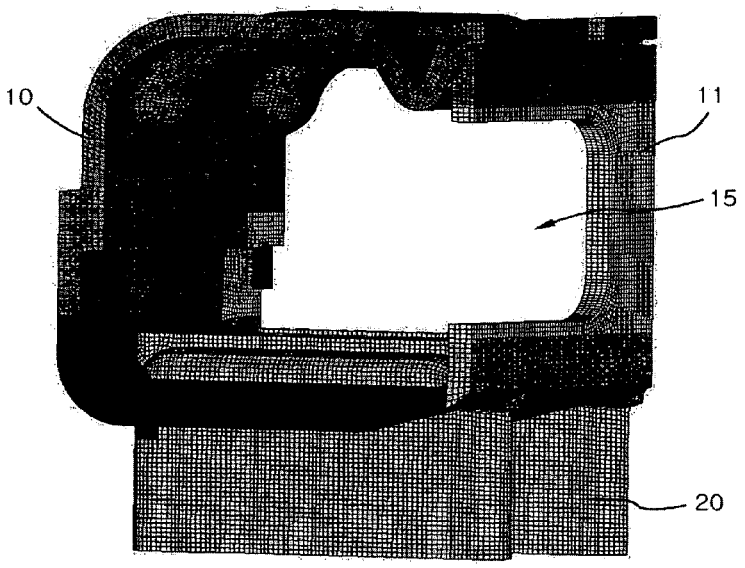

FIG. 9 is a graph showing a relationship between a cross-sectional area of the partition wall having the communication hole and a fracture pressure and FIG. 10 is a view visually showing the result of structural analysis of a header-tank. The cross-sectional area of the partition wall 11 having the communication hole 15 is correspondent to a portion of $S_t$ in FIG. 10. As shown in FIG. 9, a magnitude of an endurable fracture pressure is increased, as the cross-sectional area of the partition wall 11 having the communication hole 15 is creased. At this time, in order to secure minimum durability of the heat exchanger, it should endure a fracture pressure of 20 kg/cm$^2$, and thus the cross-sectional area of the partition wall 11 having the communication hole 15 should be at least 7 mm$^2$ or more. Meanwhile, in order to increase the durability, it is better to provide a lager cross-sectional area ($S_t$ in FIG. 10) at the partition wall 11 having the communication hole 15. However, since the size (S in FIG. 4) of the communication hole 15 is reduced as the cross-sectional area of the partition wall 11 having the communication hole 15 is increased, it is difficult to simplify the communication hole 15, the pressure drop of the refrigerant is increased, and thus it shows poor characteristic in the economic aspect. Therefore, it is preferable that the cross-sectional area of the communication hole 15 is 20 mm$^2$ or less. If the thickness of the partition wall 11 having the communication hole 15 is 2 mm, it is preferable that a distance between the communication holes 15 is in an extent of 3.5~10 mm corresponding to the minimum cross-sectional area.

Referring to FIGS. 5 to 10, in the processes of optimizing the position, the number, the size and the distance of the communication hole, assuming that a distance from the baffle 12 to the end cap 14 is 100%, preferably, the communication hole 15 is positioned on the partition wall 11 of the rear space of the baffle 12 of the header-tank in an extent of 0~50% or 65~100%, the number of the communication holes 15 is from one to four, the size of the communication hole 15 is determined so that the ratio of the surface area (S) of the communication hole/the cross-sectional area ($S_T$) of the header-tank is 70~160%, and the communication holes 15 are spaced apart from each other so that the cross-sectional area ($S_t$) of the partition wall 11 having the communication hole 15 is in an extent of 7~20 mm$^2$. By the structure of the communication hole 15 as described above, it is possible to maximize the heat exchange performance and also increase the durability. Furthermore, since the structure of the communication hole 15 is simplified, it is facile to design and manufacture the heat exchanger and also to change its structure.

Those skilled in the art will appreciate that the conceptions and specific embodiments disclosed in the foregoing description may be readily utilized as a basis for modifying or designing other embodiments for carrying out the same purposes of the present invention. Those skilled in the art will also appreciate that such equivalent embodiments do not depart from the spirit and scope of the invention as set forth in the appended claims.

INDUSTRIAL APPLICABILITY

According to the present invention, since the structure of the communication hole is simplified, it is facile to design and manufacture the heat exchanger, and thus it is possible to remarkably reduce the designing and manufacturing cost. Further, in the present invention, the refrigerant flow is improved by restricting generation of a dead zone so that the refrigerant is uniformly distributed and thus the temperature distribution also becomes uniform, thereby remarkably increasing the heat exchange performance of the heat exchanger.

Further, in the conventional invention, since the communication hole was formed at every tube, the structure of the communication hole was directly affected by the number of the tubes. However, in the present invention, since the structure of the communication hole is not affected by the number of the tubes, although the structure of the tube and the fin is changed, it is not necessary to change the structure of the communication hole, or it is very simple to change the structure of the communication hole, thereby facilely manufacturing a new product.

Furthermore, in the conventional invention, since many communication holes was formed at the internal wall of the header-tank and thus stress was concentrated on the internal wall between the communication holes, it was easy to damage the internal wall of the header-tank, thereby reducing the durability. However, since the present invention can optimize the position and size of the communicating hole, it is possible to smoothly flow the refrigerant and also prevent the concentration of stress, thereby considerably enhancing the durability.

The invention claimed is:

1. A heat exchanger, comprising:

a pair of header-tanks which are arranged in parallel to be spaced apart from each other, and each of which defines an inner space as a first refrigerant passage when both longitudinal ends are closed and comprises at least one partition wall that partitions the first refrigerant passage along a width direction and at least one baffle that partitions the first refrigerant passage along a longitudinal direction;

a plurality of tubes of which both ends are fixedly inserted into the pair of header-tanks to form a second refrigerant passage; and a plurality of fins which are interposed between the tubes, wherein said at least one partition wall includes one or more communication holes, said one or more communication holes are formed on the partition wall that is positioned at a region disposed between the baffle and one end of the header-tank adjacent to the baffle, assuming that a distance from the baffle to the one end of the header-tank is 100%, said one or more communication holes are formed at positions on the partition wall which corresponds to an extent of 0~50%, and a ratio of a surface area of said one or more communication holes per a cross-sectional area of the header-tank is in an extent of 70~160%.

2. A heat exchanger, comprising:

a pair of header-tanks which are arranged in parallel to be spaced apart from each other, and each of which defines an inner space as a first refrigerant passage when both longitudinal ends are closed and comprises at least one partition wall that partitions the first refrigerant passage along a width direction and at least one baffle that partitions the first refrigerant passage along a longitudinal direction;

a plurality of tubes of which both ends are fixedly inserted into the header-tank to form a second refrigerant passage; and a plurality of fins which are interposed between the tubes, wherein said at least one partition wall includes one or more communication holes, said one or more communication holes are formed on the partition wall that is positioned at a region disposed between the baffle and one end of the header-tank adjacent to the baffle, assuming that a distance from the baffle to the one end of the header-tank is 100%, said one or more communication holes are formed at positions on the partition wall which corresponds to an extent of 65~100%, and a ratio of a surface area of said one or more communication holes per a cross-sectional area of the header-tank is in an extent of 70~240%.

3. The heat exchanger according to claim 1, wherein the baffle is formed at one of the pair of the header-tanks.

4. The heat exchanger according to claim 1, wherein each of the header-tanks includes end caps that close the both longitudinal ends of the header-tank.

5. The heat exchanger according to claim 1, wherein said heat exchanger includes first and second rows, and said baffle includes first and second baffles, said first and second rows are provided with the first and second baffles, respectively, and said first and second baffles are parallel to each other.

6. The heat exchanger according to claim 1, wherein the one or more communication holes are disposed at positions on the partition wall which corresponds to an extent of 65~100% and the communication holes include four communication holes.

7. The heat exchanger according to claim 2, wherein said heat exchanger includes first and second rows, and said baffle includes first and second baffles, said first and second rows are provided with the first and second baffles, respectively, and said first and second baffles are parallel to each other.

8. The heat exchanger according to claim 2, wherein the ratio of the surface area of said one or more communication holes per the cross-sectional area of the header-tank is in an extent of 70~160%.

9. The heat exchanger according to claim 1, wherein a cross-sectional area of the partition wall having said one or more communication holes is in an extent of 7~20 $mm^2$.

10. The heat exchanger according to claim 2, wherein a cross-sectional area of the partition wall having said one or more communication holes is in an extent of 7~20 $mm^2$.

11. The heat exchanger according to claim 9, wherein a thickness of the partition wall is 2 mm, and a distance between the communication holes is in an extent of 3.5~10 mm.

12. The heat exchanger according to claim 10, wherein a thickness of the partition wall is 2 mm, and a distance between the communication holes is in an extent of 3.5~10 mm.

13. The heat exchanger according to claim 11, wherein the baffle is disposed inside the upper header-tank and the communication hole is formed at an upper partition wall, and the refrigerant in the heat exchanger is introduced into a front space of the baffle of a first row of upper header-tank, passed through a tube, a first row of lower header-tank, a tube, a rear space of the baffle of the first row of upper header-tank, the communication hole, a rear space of the baffle of the second row of upper header-tank, a tube, a second row of lower header-tank, a tube, and then exhausted to an outside through a front space of the baffle of the second row of upper header-tank.

14. The heat exchanger according to claim 12, wherein the baffle is disposed inside the upper header-tank, and the communication hole is formed at an upper partition wall, and the refrigerant in the heat exchanger is introduced into a front space of the baffle of a first row of upper header-tank, passed through a tube, a first row of lower header-tank, a tube, a rear space of the baffle of the first row of upper header-tank, the communication hole, a rear space of the baffle of the second row of upper header-tank, a tube, a second row of lower header-tank, a tube, and then exhausted to an outside through a front space of the baffle of the second row of upper header-tank.

15. The heat exchanger according to claim 11, wherein the baffle is disposed inside the lower header-tank, and the communication hole is formed at a lower partition wall, and the refrigerant in the heat exchanger is introduced into a front space of the baffle of a first row of lower header-tank, passed through a tube, a first row of upper header-tank, a tube, a rear space of the baffle of the first row of lower header-tank in turn, the communication hole, a rear space of the baffle of the second row of lower header-tank, a tube, a second row of upper header-tank, a tube in turn, and then exhausted to an outside through a front space of the baffle of the second row of lower header-tank.

16. The heat exchanger according to claim 12, wherein the baffle is disposed inside the lower header-tank, and the communication hole is formed at a lower partition wall, and the refrigerant in the heat exchanger is introduced into a front space of the baffle of a first row of lower header-tank, passed through a tube, a first row of upper header-tank, a tube, a rear space of the baffle of the first row of lower header-tank in turn, the communication hole, a rear space of the baffle of the second row of lower header-tank, a tube, a second row of upper header-tank, a tube in turn, and then exhausted to an outside through a front space of the baffle of the second row of lower header-tank.

17. The heat exchanger according to claim 11, wherein the baffle includes upper and lower baffles, which are disposed inside an upper header-tank and a lower header-tank, respectively, the one or more communication holes are formed at a position on a lower partition wall, sad lower partition wall is between an end of the lower header-tank which is opposite to an inlet and outlet port of refrigerant and the lower baffle adjacent thereto, and the heat exchanger is configured to introduce the refrigerant into a front space of the upper baffle of a first row of the upper header-tank, pass the refrigerant through a tube, a front space of the lower baffle of the first row of the lower header-tank, a tube, a rear space of the upper baffle of a first row of upper header-tank, the communication hole, a rear space of the lower baffle of the second row of lower header-tank, a tube, a rear space of the upper baffle of the second row of upper header-tank, a tube, a front space of the lower baffle of the second row of lower header-tank, a tube in turn, and then exhaust the refrigerant to an outside through a front space of the lower baffle of the second row of lower header tank.

18. The heat exchanger according to claim 12, wherein the baffle includes upper and lower baffles, which are disposed inside an upper header-tank and a lower header-tank, respectively, the one or more communication holes are formed at a position on a lower partition wall, said lower partition wall is between an end of the lower header-tank which is opposite to an inlet and outlet port of refrigerant and the lower baffle adjacent thereto, and the heat exchanger is configured to introduce the refrigerant into a front space of the upper baffle of a first row of the upper header-tank, pass the refrigerant through a tube, a front space of the lower baffle of the first row of the lower header-tank, a tube, a rear space of the upper baffle of a first row of upper header-tank, the communication hole, a rear space of the lower baffle of the second row of lower header-tank, a tube, a rear space of the upper baffle of the second row of upper header-tank, a tube, a front space of the lower baffle of the second row of lower header-tank, a tube in turn, and then exhaust the refrigerant to an outside through a front space of the lower baffle of the second row of lower header tank.

19. A heat exchanger, comprising:

a pair of header-tanks which are arranged in parallel to be spaced apart from each other, and each of which defines an inner space as a first refrigerant passage when both longitudinal ends are closed and comprises at least one partition wall that partitions the first refrigerant passage along a width direction and at least one baffle that partitions the first refrigerant passage along a longitudinal direction;

a plurality of tubes of which both ends are fixedly inserted into the header-tank to form a second refrigerant passage; and a plurality of fins which are interposed between the tubes, wherein said at least one partition wall includes one or more communication holes, said one or more communication holes are formed on the partition wall that is positioned at a region disposed between the baffle and one end of the header-tank adjacent to the baffle, and a ratio of a surface area of said one or more communication holes per a cross-sectional area of the header-tank is in an extent of 70~160%.

20. The heat exchanger according to claim 19, wherein a cross-sectional area of the partition wall having said one or more communication holes is in an extent of 7~20 $mm^2$.

21. The heat exchanger according to claim 20, wherein a thickness of the partition wall is 2 mm, and a distance between the one or more communication holes is in an extent of 3.5~10 mm.

* * * * *